US010555612B2

(12) United States Patent
Kellock et al.

(10) Patent No.: US 10,555,612 B2
(45) Date of Patent: Feb. 11, 2020

(54) ADJUSTABLE HEAD SUPPORTING TRAVEL ACCESSORY

(71) Applicant: Coolside Limited, Glasgow (GB)

(72) Inventors: David Kellock, Troon (GB); Michael Corrigan, Glasgow (GB); Thomas Leech, London (GB)

(73) Assignee: Coolside Limited, Glasgow (GB)

( * ) Notice: Subject to any disclaimer, the term of this patent is extended or adjusted under 35 U.S.C. 154(b) by 0 days.

(21) Appl. No.: 16/284,951

(22) Filed: Feb. 25, 2019

(65) Prior Publication Data

US 2019/0298067 A1 Oct. 3, 2019

Related U.S. Application Data

(63) Continuation of application No. PCT/GB2018/052362, filed on Aug. 20, 2018.

(51) Int. Cl.
*A47C 7/36* (2006.01)
*A47C 7/38* (2006.01)

(52) U.S. Cl.
CPC ..... *A47C 7/383* (2013.01)

(58) Field of Classification Search
CPC ..... A47C 7/36; A47C 7/38
USPC ..... 5/636, 630, 640, 643
See application file for complete search history.

(56) References Cited

U.S. PATENT DOCUMENTS 3,776,224 A * 12/1973 McFarland ..... A61F 5/055 128/DIG. 23
4,034,747 A 7/1977 Leroy
4,854,306 A 8/1989 Pujals, Jr.
5,205,813 A 4/1993 Schmidt
(Continued)

FOREIGN PATENT DOCUMENTS

GB 2049436 12/1980
GB 2366181 3/2002
(Continued)

OTHER PUBLICATIONS

U.S. Appl. No. 14/405,115, Amendment and Response filed Dec. 10, 2018 to Final Office Action dated Aug. 8, 2018, 11 pgs.
(Continued)

*Primary Examiner* — Fredrick C Conley
(74) *Attorney, Agent, or Firm* — Schwegman Lundberg & Woessner, P.A.

(57) ABSTRACT

Disclosed herein is an adjustable head supporting apparatus. In the illustrated examples, a garment encases the adjustable head supporting apparatus. The apparatus may include a contoured head element, a contoured shoulder element, and at least one connecting member connectable to each of the head element and the shoulder element. The at least one connecting member may be configured to link the head element and the shoulder element such that the at least one connecting member facilitates displacing the head element and the shoulder element to adjust spacing between them and the at least one connecting member. Displacement of a first end of the head element and displacement of a first end of the shoulder element can be independent of displacement of a second end of the head element and a second end of the shoulder element. The head element and the shoulder element may be encased within a fabric garment.

25 Claims, 11 Drawing Sheets

(56) References Cited

U.S. PATENT DOCUMENTS

| | | | | |
|---|---|---|---|---|
| 5,220,700 | A | 6/1993 | Liu | |
| 5,722,939 | A * | 3/1998 | Hohlen | A61F 5/055 602/18 |
| 6,289,538 | B1 | 9/2001 | Fidge | |
| 6,447,468 | B1 | 9/2002 | Hankins et al. | |
| 8,898,840 | B1 | 12/2014 | Majette | |
| 10,098,464 | B2 | 10/2018 | Kellock et al. | |
| 2004/0204666 | A1* | 10/2004 | Marsh | A61F 5/055 602/18 |
| 2005/0113728 | A1 | 5/2005 | Heinz et al. | |
| 2011/0169316 | A1 | 7/2011 | Goei et al. | |
| 2015/0157130 | A1 | 6/2015 | Kellock et al. | |
| 2016/0220410 | A1 | 8/2016 | Hwang | |
| 2018/0028091 | A1 | 2/2018 | Huang | |
| 2018/0103764 | A1 | 4/2018 | Kellock et al. | |

FOREIGN PATENT DOCUMENTS

| | | | |
|---|---|---|---|
| WO | WO-2005039441 | | 5/2005 |
| WO | WO-2013/178979 | A1 | 12/2013 |
| WO | WO-2013178979 | | 12/2013 |

OTHER PUBLICATIONS

U.S. Appl. No. 14/405,115, Examiner Interview Summary dated Feb. 1, 2019, 1 pgs.
U.S. Appl. No. 14/405,115, Examiner Interview Summary dated Dec. 4, 2018, 3 pgs.
U.S. Appl. No. 14/405,115, Final Office Action dated Jun. 23, 2017, 10 pgs.
U.S. Appl. No. 14/405,115, Final Office Action dated Aug. 8, 2018, 14 pgs.
U.S. Appl. No. 14/405,115, Non Final Office Action dated Jan. 10, 2017, 10 pgs.
U.S. Appl. No. 14/405,115, Non Final Office Action dated Feb. 1, 2019, 14 pgs.
U.S. Appl. No. 14/405,115, Non Final Office Action dated Mar. 27, 2018, 13 pgs.
U.S. Appl. No. 14/405,115, Notice of Allowance dated Oct. 11, 2017, 5 pgs.
U.S. Appl. No. 14/405,115, Preliminary Amendment filed Dec. 2, 2014, 9 pgs.
U.S. Appl. No. 14/405,115, Repnse filed Apr. 10, 2017 to Non Final Office Action dated Jan. 10, 2017, 9 pgs.
U.S. Appl. No. 14/405,115, Response filed Apr. 30, 2018 to Non Final Office Action dated Mar. 27, 2018, 23 pgs.
U.S. Appl. No. 14/405,115, Response filed Sep. 13, 2017 to Final Office Action dated Jun. 23, 2017, 10 pgs.
U.S. Appl. No. 15/843,890, Final Office Action dated Jul. 12, 2018, 11 pgs.
U.S. Appl. No. 15/843,890, Non Final Office Action dated Jan. 25, 2018, 11 pgs.
U.S. Appl. No. 15/843,890, Notice of Allowance dated Sep. 6, 2018, 5 pgs.
U.S. Appl. No. 15/843,890, Preliminary Amendment filed Dec. 19, 2017.
U.S. Appl. No. 15/843,890, Response filed Aug. 14, 2018 to Final Office Action dated Jul. 12, 2018, 5 pgs.
U.S. Appl. No. 15/843,890, Response to Non Final Office Action dated Jan. 25, 2018 filed Apr. 5, 2018, 10 pgs.
Australian Application No. 2013269365, Patent Examination Report No. 1 dated Sep. 16, 2016, 3 pgs.
Chinese Application Serial No. 201380029142.4, Office Action dated Apr. 24, 2017, w/English Translation, 31 pgs.
European Application No. 13736935.1, Communication Pursuant to Article 94(3) EPC dated Aug. 12, 2016, 22 pgs.
European Application Ser. No. 13736935.1, Office Action dated Jan. 16, 2015, 2 pgs.
European Application Ser. No. 13736935.1, Office Action dated Aug. 12, 2016, 4 pgs.
European Application Ser. No. 13736935.1, Response filed Jul. 22, 2015 to Office Action dated Jan. 16, 2015, 12 pgs.
International Application No. PCT/GB2013/000246, International Search Report and Written Opinion dated Sep. 16, 2013, (Sep. 16, 2013), 10 pgs.
Japanese Application No. 2015-514571, Notification of Reasons for Refusal dated Jan. 23, 2018, (with English machine translation from Global Dossier system), 6 pgs.
PCT/GB2018/052362, International Search Report and Written Opinion dated Oct. 23, 2018, 12 pgs.
UAE Application Serial No. 1327/2014, Korean Examination Report dated Jan. 7, 2019, 9 pgs.
UAE Application Serial No. 1327/2014, Korean Search Report dated Jan. 7, 2019, 5 pgs.
"UK Application Serial No. GB1813516.0, Combined Search and Examination Report under Sections 17 and 18(3) dated Feb. 19, 2019", 5 pgs.
U.S. Appl. No. 14/405,115, Response filed May 30, 2019 to Non Final Office Action dated Feb. 1, 2019, 12 pgs.
"U.S. Appl. No. 14/405,115, Final Office Action dated Aug. 8, 2019", 12 pgs.
U.S. Appl. No. 14/405,115, Response filed Oct. 8, 2019 to Final Office Action dated Aug. 8, 2019, 14 pgs.
U.S. Appl. No. 14/405,115, Notice of Allowance dated Nov. 14, 2019, 9 pgs.

* cited by examiner

ADJUSTABLE HEAD SUPPORTING TRAVEL ACCESSORY

CLAIM OF PRIORITY

This application is a continuation under 35 U.S.C. § 111(a) claims the benefit of priority to International Application No. PCT/GB2018/052362, filed on Aug. 20, 2018, which claims the benefit of priority to United Kingdom Patent Application No. 1805175.5, filed on Mar. 29, 2018, each of which is incorporated by reference herein in its entirety.

FIELD OF THE INVENTION

The present invention relates to an anchored head supporting travel accessory. In particular, the anchored head supporting travel accessory includes manual adjustment of support elements to enhance comfort and support for the user.

BACKGROUND TO THE INVENTION

Travel pillows are commonly used by people travelling as a passenger in a car, aeroplane, bus, train or boat. Often, the best way to deal with a long journey is to sleep until you arrive at your destination, but often sleeping when in a seated position leads to pain or discomfort in the neck due to the natural collapsing (involuntary tilting) of the head to the side, front or back when the passenger relaxes into sleep mode.

Travel pillows take various forms and include various filling materials, for example a travel pillow can be inflatable, can be filled with microbeads, can include an internal frame structure, can be U-shaped, can be C-shaped or can even cover the whole head. Typically, most of the known travel pillows provide comfort and a degree of support to a user whilst sitting with their head upright, but most of the known travel pillows provide little or insufficient support when the head collapses naturally (involuntary tilts) to the side, front or back.

SUMMARY OF THE INVENTION

A first aspect of the present invention provides an adjustable head supporting apparatus configured, in use, to be anchored against a user's neck, wherein the apparatus comprises:

- a contoured head element;
- a contoured shoulder element; and
- at least one connecting member connectable to each of the head element and the shoulder element;
- wherein the at least one connecting member is configured to link respective ends of the head element with respective ends of the shoulder element; and
- wherein the at least one connecting member facilitates displacing the head element and the shoulder element to adjust spacing between the head element and the shoulder element, wherein displacement of a first end of the head element relative to a first end of the shoulder element is independent of displacement of a second end of the head element relative to a second end of the shoulder element; and
- wherein the at least the head element and the shoulder element are encased within a fabric garment, wherein the fabric garment anchors the adjustable head supporting apparatus against a user's neck.

By anchoring the adjustable head supporting apparatus against the user's neck active comfort and support is provided. By providing manual displacement of the shoulder element and head element the degree of comfort and support can be enhanced. In particular, adjustment of the shoulder element and the head element relative to the connecting member ensures comfort and support in the normal sitting position, whilst also providing responsive support to the user's head as it tilts voluntary or involuntary and exerts pressure on the head element.

The adjustable head supporting apparatus may further comprise at least one fastening unit operable to join the connecting member, the head element and the shoulder element, wherein the fastening unit is operable to lock together the connecting member, the head element and the shoulder element thereby preventing displacement of the head and shoulder element; and wherein upon releasing the fastening unit displacement of the head and shoulder element is permitted.

The fastening unit may comprise an actuator, wherein the actuator facilitates manual release and manual displacement of the fastening unit relative to the connecting member, the head element and the shoulder element, and wherein displacement of the fastening unit causes displacement of corresponding ends of the head and shoulder element.

The fastening unit may further comprise a resilient member operable to bias the fastening unit to a locked configuration and wherein upon applying a bias-overriding load to the fastening unit, via the actuator, the fastening unit is released and capable of displacing the head and shoulder element.

The fastening unit may further comprise a retaining element configured to engage with the connecting member, thereby preventing displacement of the fastening unit until disengagement of the retaining element and the connecting member.

The retaining element and the connecting member may each comprise complementary mating surfaces, wherein in the locked position the mating surfaces prevent displacement of the fastening unit.

Upon release of the actuator, the resilient member may be operable to partially displace the fastening unit to align the mating surfaces of the retaining element and the connecting member such that the biasing force of the resilient element automatically locks the fastening unit and the connecting member, thereby preventing displacement of the head element and the shoulder element.

Each of the head element and the shoulder element may comprise adjusting members comprising a serrated edge configured to engage with a complementary serrated surface on the fastening unit, wherein upon releasing the fastening unit rotation of the fastening unit is permitted, wherein rotation of the fastening unit causes translational displacement of the head element and the shoulder element relative to a stationary connecting member.

Rotation of the fastening unit may synchronously displace the head element and the shoulder element.

The head element and the shoulder element may each comprise at least one adjusting member, wherein an adjusting member of each of the head element and the shoulder element is engageable with the fastening unit.

The connecting member may comprise a passageway configured to receive and guide an adjusting member from each of head element and the shoulder element, wherein one of the passageway or the adjusting member includes a projecting element and one of the passageway or the adjusting member includes a groove, wherein the projecting element engages with and is guided in the groove.

The passageway guides translational movement of the adjusting elements of the head element and the shoulder element.

Upon rotation of the fastening unit the head element and shoulder element displace translationally in opposite directions due to engagement of the adjusting elements with a body of the fastening unit.

The connecting member may be elongated, wherein a unitary connecting member is configured to be linked at each end to a corresponding end of each of the head element and the shoulder element and wherein a fastening unit is provided at each end.

The head element and the shoulder element may each be provided by a contoured support member comprising asymmetrically spaced adjusting members, wherein an adjusting member of two contoured support members are engageable with each fastening unit.

The connecting member may comprise a passageway at both ends, wherein a fastening unit passes through the connecting member and the passageway such that the body of the fastening unit engages with the adjusting elements received in the respective passageway.

The garment may be provided by a sleeve, which includes two pockets extending along an inside of a front portion of the sleeve, wherein a closed end of a first pocket is located adjacent to a first open end of the sleeve and a closed end of a second pocket is located adjacent a second open end of the sleeve.

Each pocket may be partially closed along an edge facing a centreline of the sleeve, wherein each edge includes two openings, which provide insertion points for the shoulder and head elements.

Two holes may be symmetrically placed along the centre line and about a midway point on the front of the sleeve, wherein each hole permits a head of a manual actuator to extend through from inside to outside of the sleeve such that the head of the actuator is exposed for manual adjustment of the adjustable head supporting apparatus.

A front surface of the sleeve adjacent to each hole may comprise an external pocket adjacent to each hole such that an open edge of each pocket overlaps the head of the manual actuator such that the head of the manual actuator can be revealed or concealed by moving an open edge of the pocket.

The fabric garment may further comprise an adjuster, which is operable to tighten the fabric garment about the user's neck.

The adjuster may comprise a pull cord arrangement, wherein a cord extends within the sleeve and wherein moving a toggle relative to the cord towards the garment facilitates tightening the garment by gathering the garment about the user's neck and wherein moving the toggle relative to the cord away from the garment facilitates releasing the cord and loosens the garment for ease of removal.

The adjuster may comprise a dual-toggle arrangement, wherein a first toggle is located adjacent to a first end of the adjustable head supporting apparatus and a second toggle is located adjacent to a second end of the adjustable head supporting apparatus.

Alternatively, the adjuster may comprise a hook and loop system configured to permit tightening the garment about a user's neck thereby anchoring the adjustable head supporting apparatus relative to a user's head, neck and shoulder, wherein the hook and loop fastening system may include hook and loop fastening around at least part of the garment and at least one tab of hook and loop fastener, wherein adjustment is facilitated by adjusting the position of the tab relative to the hook and loop fastening, thereby tightening or loosening the garment relative to the user's neck.

Alternatively, the fabric garment may comprise an elongated scarf comprising a head portion and a tail portion, wherein the tail portion is an elongated length of material extending from the head portion; and wherein the head element and the shoulder element are encased in the head portion.

The head portion may include two pockets extending along an inside surface of the head portion, wherein a first pocket extends down from a top edge of the head portion and a second pocket extends up from a bottom edge of the head portion.

Each pocket may be partially closed along an internal edge, which is provide adjacent to an axial centreline of the scarf. Each internal edge includes two openings, wherein the openings provide insertion points for the shoulder and head elements of the internal support structure.

Two holes may be symmetrically located on a centre line and through an outside surface of the head portion. A head of each actuator extends through a respective hole from the inside surface of the scarf to the outside of the scarf such that the heads are exposed and accessible to the user to manually adjust the spacing between the shoulder element and the head element.

One or more sections of hook fastening may be provided adjacent inside edges of an end section of the tail portion.

The outside surface of the scarf may include a material that complements the hook fastening tape such that the end section of the tail portion can be secured to the outside surface of the scarf when the tail portion is wrapped around the internal support structure and the user's neck. By providing the outside surface as a material that complements the hook fastening the tail portion can be secured at any position along the length of the scarf.

Alternatively, one or more sections of loop fastening may be provided along the length of the scarf on the outside surface from the tail portion. Engagement of the hook fastening and the loop fastening anchors the internal support structure against the user's neck whilst maintaining the position of the head element relative to the lower part of the user's face.

BRIEF DESCRIPTION OF THE DRAWINGS

Embodiments of the present invention are described below, by way of example only, with reference to the accompanying drawings, in which.

DESCRIPTION

Figure 1:
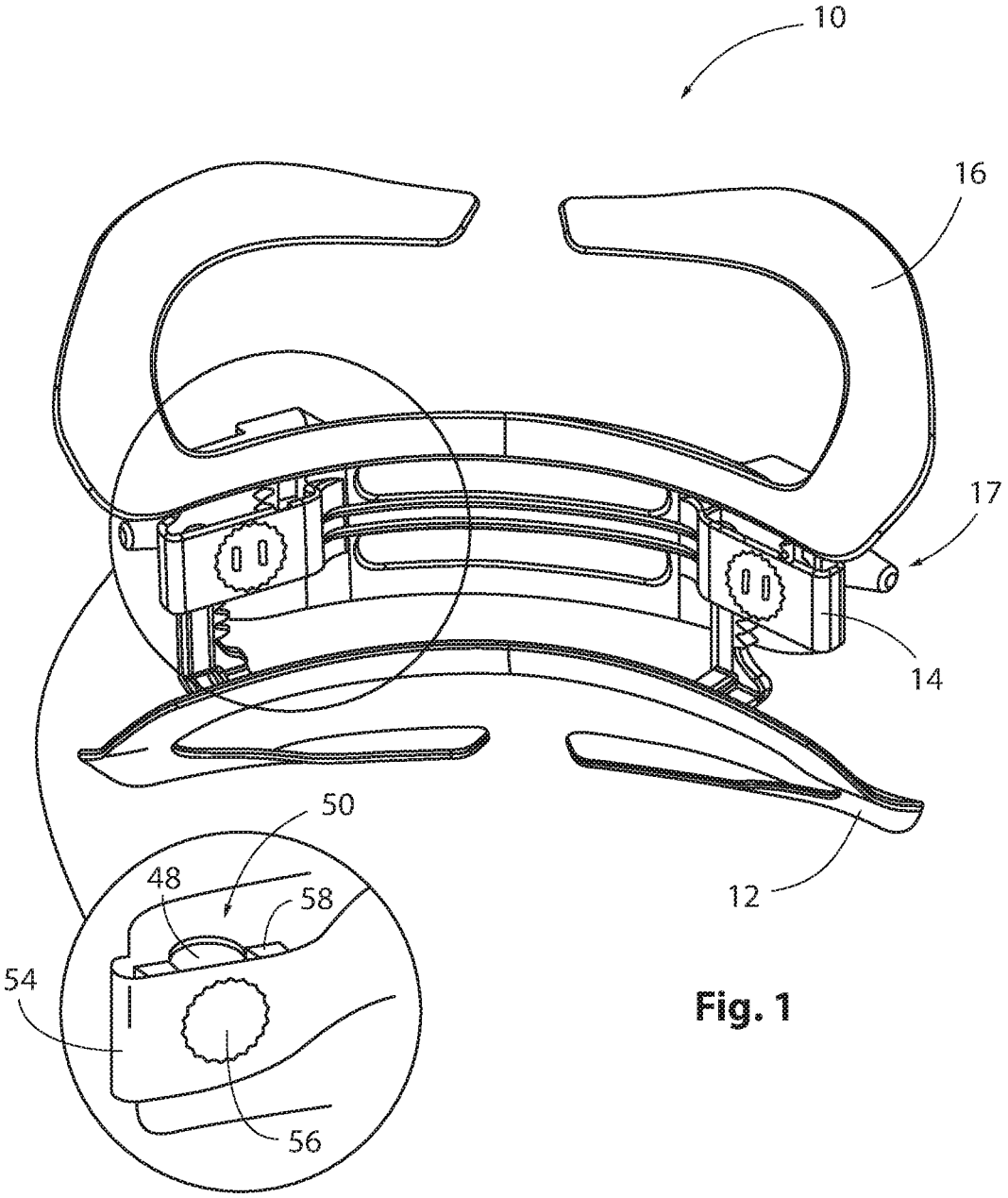
FIG. 1 is a schematic representation of an assembled internal support structure viewed from the neck engaging side.

An internal support structure 10 for an adjustable head supporting travel accessory 100, 200 is illustrated in FIGS. 1 to 4. The adjustable head supporting travel accessory 100 is illustrated in FIGS. 6, 7 and 9.

The internal support structure 10 includes an assembly of a shoulder element 12, a neck element 14, a head element 16 and two fastening units 17. The neck element 14 facilitates anchoring the structure 10 relative to a user's neck when in use as described further below with reference to FIGS. 6 to 10 and 11*a* to 12*d*.

Figure 6:
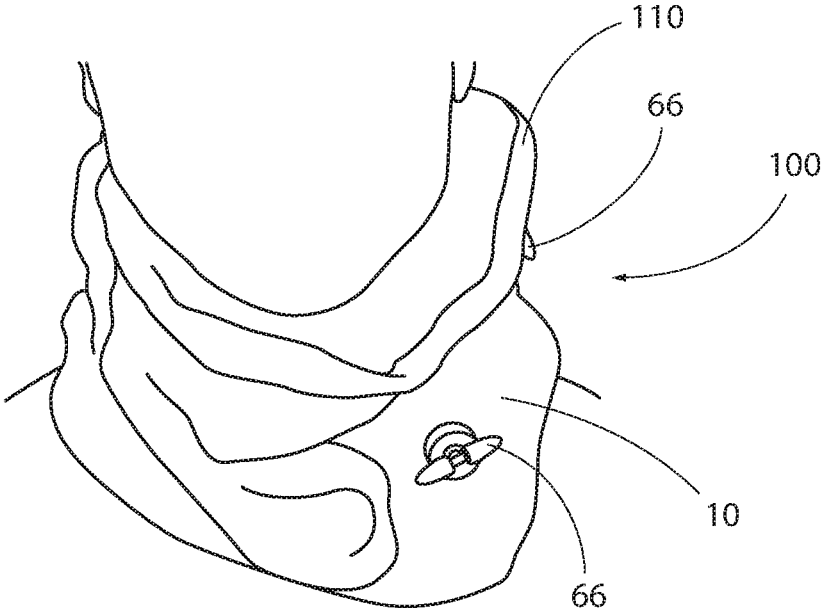
FIG. 6 is an illustration of a left-side view of a model wearing a garment encasing the internal support structure illustrated in FIGS. 1 to 4.
Figure 7:
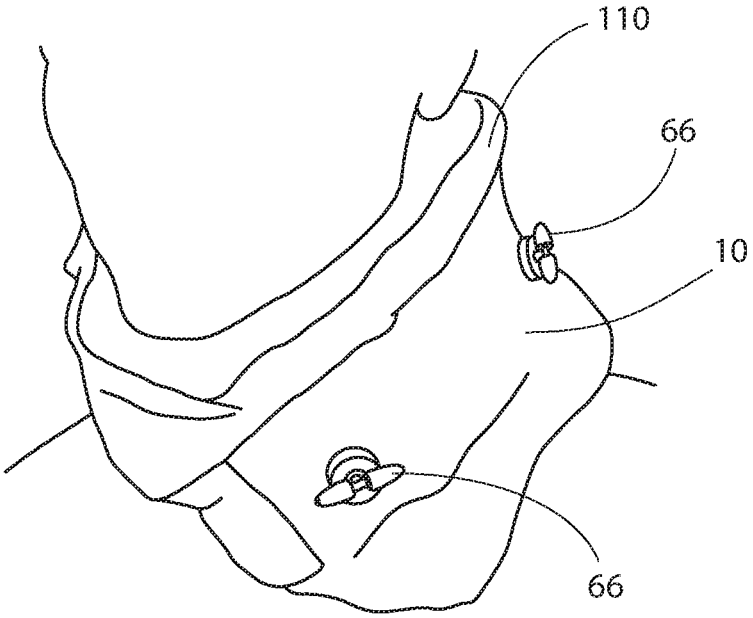
FIG. 7 is an illustration of a front view of a model wearing a garment encasing the internal support structure illustrated in FIGS. 1 to 4.
Figure 9:
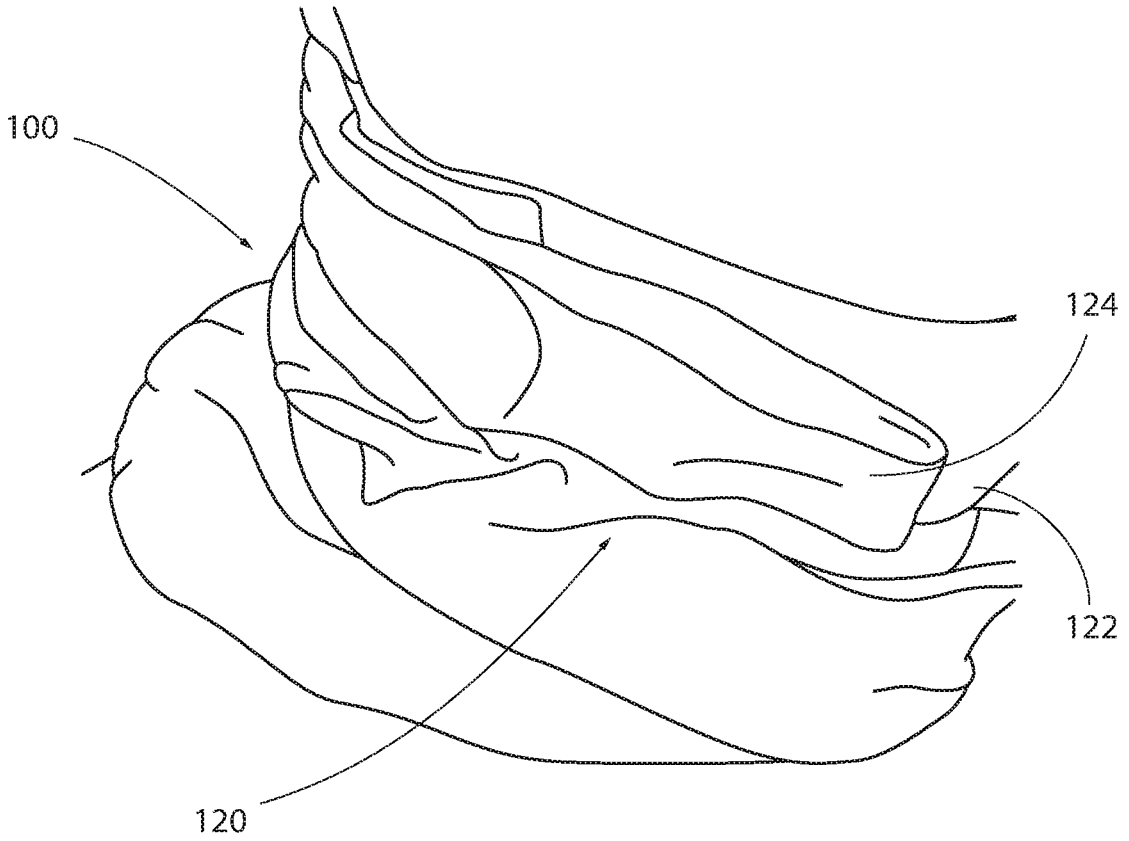
FIG. 9 is an illustration of a right-side view of a model wearing the garment encasing the internal support structure and illustrates how the garment is adjusted to fit the user's neck.

FIGS. 6, 7 and 9 illustrate the adjustable head supporting travel accessory 100, which includes a garment 110, in the form of a sleeve, which encases the internal support structure 10. In use, the garment 110 anchors the internal support structure 10 against the user's neck relative to their head and shoulder.

FIGS. 11*a* to 11*b* and 12*a* to 12*d* illustrate a garment 200, in the form of an elongated scarf 200, which, in use, anchors the internal support structure 10 against the user's neck relative to their head and shoulder.

Referring to FIGS. 1 to 5, the internal support structure 10 includes automatic adjustment and manual adjustment to optimise comfort and support for the user. Automatic adjustment is facilitated by the contoured shape and form of the shoulder element 12 and the head element 16 as described further below.

Manual adjustment is facilitated by an assembly of mating parts, which are configured to move relative to each other in a controlled manner as described below with reference to FIGS. 1 to 5*b*.

Figure 3:
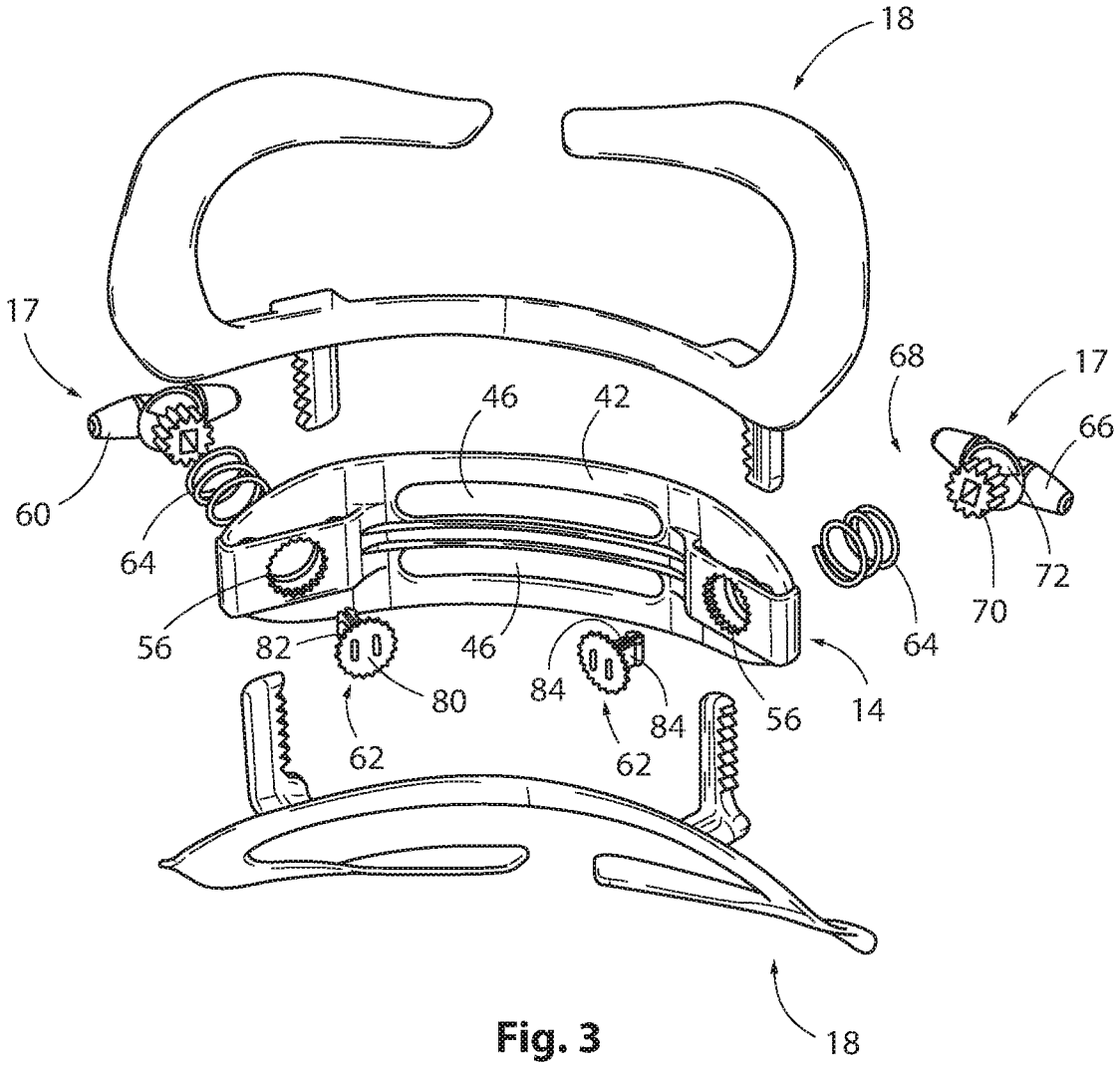
FIG. 3 is a schematic representation of an exploded view of the internal support structure illustrated in FIG. 1.

FIGS. 1 and 3 illustrate the internal support structure 10 viewed from the interior/neck engaging side of the structure 10.

Figure 2:
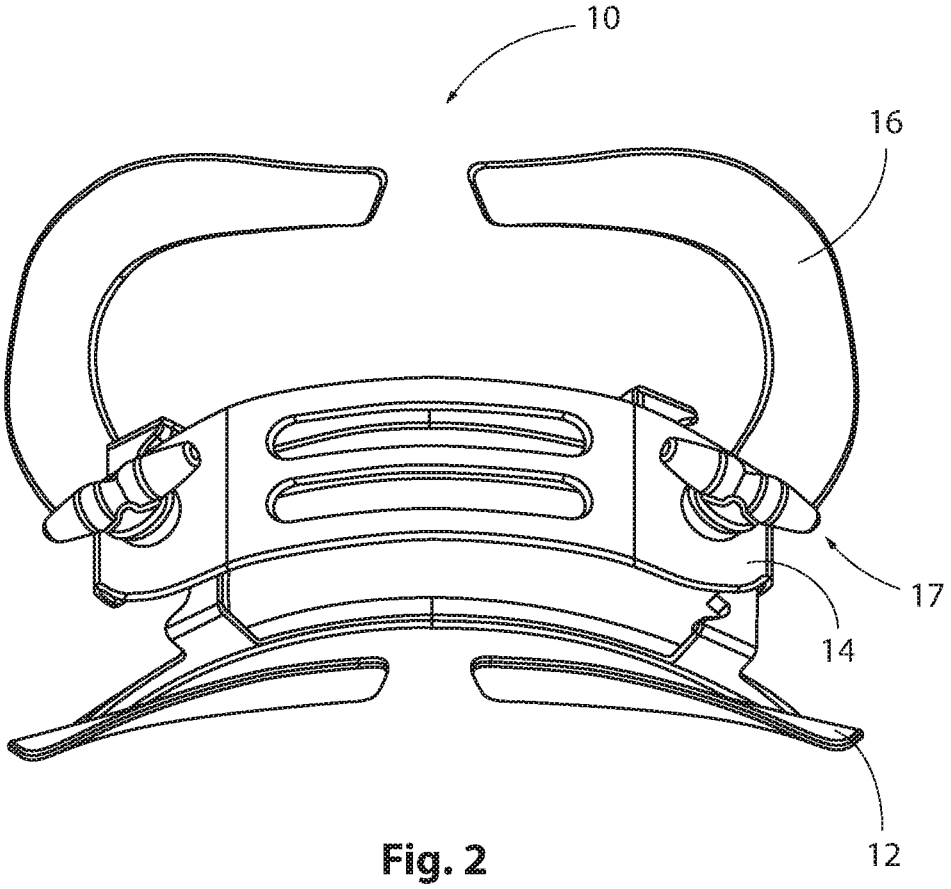
FIG. 2 is a schematic representation of an assembled internal support structure viewed from the adjustment side of the structure
Figure 4:
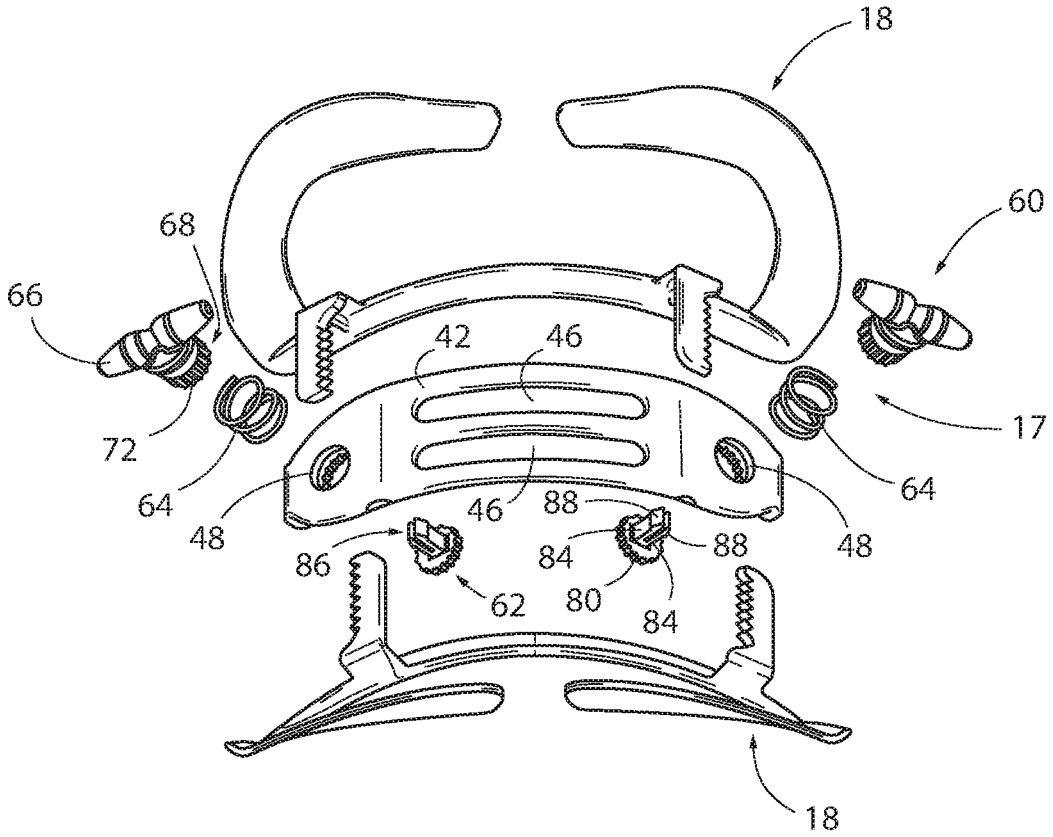
FIG. 4 is a schematic representation of an exploded view of the internal support structure illustrated in FIG. 2.

FIGS. 2 and 4 illustrate the internal support structure 10 viewed from the exterior/manual adjustment side of the structure 10.

Referring to FIGS. 3 and 4, the internal support structure 10 is shown as an exploded/dismantled arrangement such that the components forming the assembled version (FIGS. 1 and 2) are easily identified and their configuration and location within the assembly can be determined.

In the illustrated example, the shoulder element 12 and the head element 16 are identical. This simplifies manufacture and assembly of the shoulder element 12 and the head element 16 with the neck element 14 to provide the internal support structure 10 illustrated in FIGS. 1*a* and 2*a*.

Figure 5A:
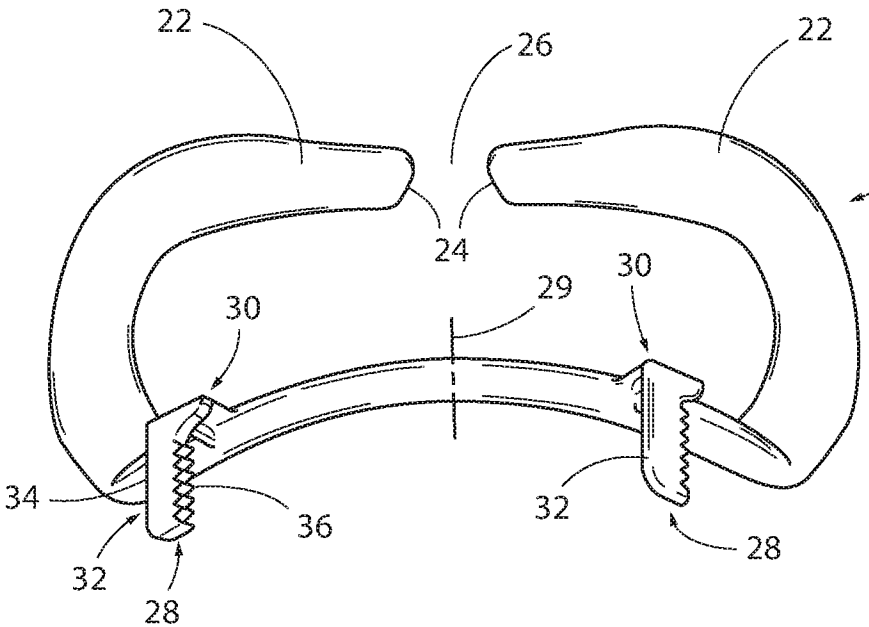
FIGS. 5*a* and 5*b* are schematic representations of a contoured support member providing a head element and a shoulder element of the internal support structure illustrated in FIGS. 1 to 4.
Figure 5B:
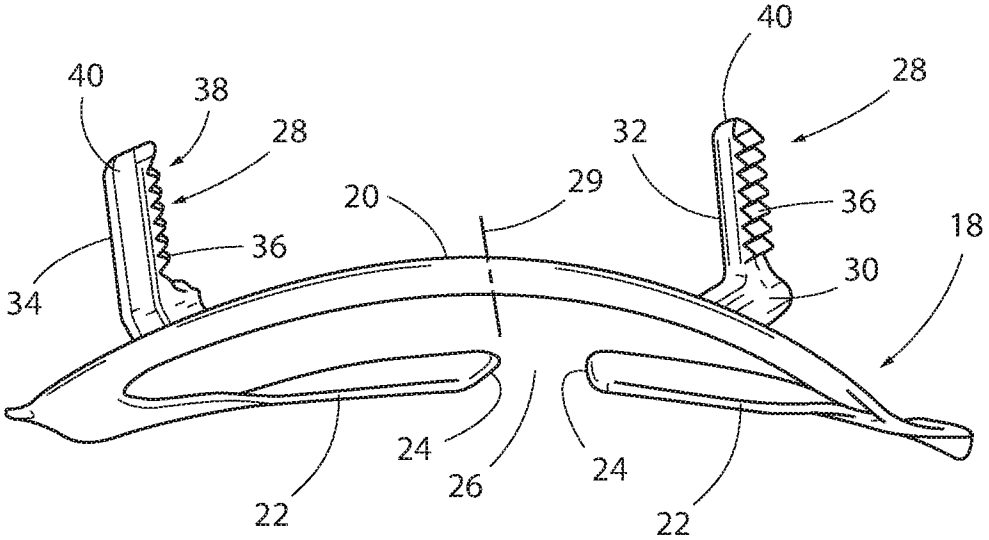

The shoulder element 12 and head element 16 are provided by a contoured support member 18 (see FIGS. 5*a* and 5*b*). In profile, the contoured support member 18 is defined by a stretched C-shape, which includes a curved elongated spine 20 and two curved limbs 22. The ends 24 of the curved limbs 22 extend towards each other and define a gap 26 therebetween. The configuration of the limbs 22, the limb ends 24 and the gap 26 is such that the limbs 22 are resilient. As such, the limbs 22 can move relative to each other in response to the shape of the body part (head or shoulder) against which the contoured support member 18 is resting in use.

The arrangement of the limbs 22, the limb ends 24 and the gap 26 is such that the position of the limbs automatically adjust to complement the shape of the body part (shoulder or head) against which the contoured support member 18 rests. This arrangement and the automatic adjustability of the limbs 22 ensures comfort for the user.

The contoured support member 18 includes two adjusting members 28, which are asymmetrically placed relative to the centre line 29 of the elongated spine 20.

Asymmetric placement of the adjusting members 28 means that the contoured support member 18 can be used for both the shoulder element 12 and the head element 16 in the assembled internal support structure 10.

Asymmetry of the adjusting members 28 permits symmetric placement of the contoured support members 18 relative to the neck element 14, as described further below.

Each adjusting member 28 is defined by an L-shaped body comprising a short leg 30 and a long leg 32. The short leg 30 extends substantially perpendicularly from an inner edge 33 of the elongated spine 20. The short leg 30 facilitates spacing the long leg 32 from the elongated spine 20. The long leg 32 extends substantially perpendicular from the short leg 30 and towards the exterior of the contoured support member 18.

The long leg 32 includes a substantially straight and smooth first edge 34 and a plurality of serrations 36 along a second edge 38. The long leg 32 includes an elongated groove 40 in an inside-facing surface proximate the first edge 34 (see FIG. 5*b*).

The long leg 32 facilitates manual adjustment of the shoulder element 12 and head element 16 relative to the neck element 14.

The elongated groove 40 controls sliding displacement of corresponding ends of the shoulder element 12 and the head element 16 relative to the neck element 14 during manual adjustment of the internal support structure 10, as described further below.

Referring to FIGS. 3 and 4, the neck element 14 includes a curved elongated connecting member 42 which is configured to link the shoulder element 12 and the head element 16.

The curvature of the elongated connecting member 42 complements the curvature of the elongated spine 20 of the contoured support member 18.

In the illustrated example, the elongated connecting member 42 is symmetric about its longitudinal and transverse axes. The elongated connecting member 42 includes two elongated vent slots 46 and two holes 48. The holes 48 are symmetrically placed relative to the transverse axis.

Two hollow passageways 50 (see FIG. 1) are defined on the concave side of the elongated connecting member 42. The concave side of the elongated connecting member 42 defines the inner face of the neck element 14 in the assembled internal support structure 10.

An external wall of each passageway 50 is defined by a portion of the elongated connecting member 42. An internal wall 52 of each passageway 50 extends from an external edge 54 of the elongated connecting member 42 and extends substantially parallel to the elongated connecting member 42 towards the transverse axis of the elongated connecting member 42.

The internal wall of each passageway 50 includes a serrated hole 56, which aligns with the corresponding hole 48 through the elongated connecting member 42.

The internal wall of each passageway 50 also includes two elongated projecting elements 58 (see FIG. 1), which project inwardly towards the external wall of each passageway 50.

In each passageway 50, one elongated projecting element 58 is configured to be received in an elongated groove 40 on the shoulder element 12 and one elongated projecting element 58 is configured to be received in an elongated groove 40 of the head element 16 when the inner support structure 10 is assembled.

In the illustrated example, the fastener unit 17 includes an assembly of an actuator 60, a retainer 62 and a spring 64.

The actuator 60 includes a head 66 and an elongated shank 68. The head 66 facilitates manual adjustment of the shoulder element 12 and the head element 16 relative to the neck element 14.

In the illustrated example, the head 66 (of the actuator 60) has the appearance of a toggle fastener, which is commonly used on outerwear, coats and jackets, for example a duffle coat.

A first portion 70 of the shank 68, from the free-end, includes a serrated outer circumference and a second portion 72 of the shank 68, from the head-end, includes a smooth outer surface. The outer diameter of the second portion 72 of the shank 68 is smaller than the diameter of the holes 48 through the elongated connecting member 42 such that, in use, the assembled fastening unit 17 can rotate relative to the holes 48 to adjust the position of the shoulder and head elements 12, 16 relative to the neck element 14 as described further below.

The configuration of the first portion 70 complements the shape and form of the teeth 36 on the adjusting members 28 provided on the shoulder and head elements 12, 16.

The elongated shank 68 is hollow and includes an internal groove (not visible) proximate the head-end 66 such that when assembled the actuator 60 and the retainer 62 are locked together, as described further below.

The retainer 62 includes a substantially flat head 80 with a serrated outer circumference, which corresponds with the shape and size of the serrated holes 56 through the internal wall 52 of the passageway 50. The retainer 62 also includes a split shank 82 which includes two cantilevered elements 84. The cantilevered elements 84 are fixed at one end to the inside surface of the flat head 80. The free ends 86 of the cantilevered elements 84 are spaced from each other.

The free end 86 of each cantilevered element includes a claw element 88. When the split shank 82 is inserted into the hollow shank 68, the claw element 88 engages with the internal groove (not visible) at the head-end of the actuator 60.

The cantilevered elements 84 are resilient such that, at least the free ends 86, are pressed together by the action of inserting the split shank 82 into the hollow shank 68. Further insertion of the split shank 82 into the hollow shank 68 pushes the claw elements 88 towards the head-end 66 of the actuator 60. When the claw element 88 aligns with the groove at the head-end 66 of the hollow shank 68 the resilience of the cantilevered elements 84 causes the free ends 86 to move away from each other such that the claw elements 88 lock behind the groove to lock the actuator 60 and retainer 62 together.

The spring 64 is received, externally, around the second portion 72 (head-end) of the shank 68. When the internal support structure 10 is assembled the spring 64 is compressed between the outer surface of the neck element 14 (curved connecting member) and the inside surface of the head 66 of the actuator 60.

The purpose of the spring 64 is to lock the position of the shoulder element 12 and the head element 16, relative to the neck element 14, after adjustment.

In the illustrated example, the spring 64 is a tensioned coil spring, which, due to spring bias, ensures engagement of the retainer head 80 and the serrated holes 56 until an overriding load is applied to the head 66 of the actuator 60.

The internal support structure 10 is produced by assembling two curved support members 18, one elongated connecting member 42, two assembled fastening units 17 and two springs 64 (see FIGS. 1 to 4).

One contoured support member 18 is positioned adjacent each elongated edge of the elongated connecting member 42 such that the curvature of the elongated spine 20 on each contoured support member 18 complements the curvature of the elongated connecting member 42.

As described above, in the assembled internal support structure 10, one contoured support member 18 provides the shoulder element 12 and one contoured support member 18 provides the head element 16.

Aligning the centre lines 29 of the contoured support members 18 and the elongated connecting member 42 aligns the adjusting members 28 with the passageways 50.

The adjusting members 28 are inserted in, the passageways 50 such that an adjusting member 28 from each contoured support member 18 is received in each passageway 50.

Insertion of the adjusting members 28 into the passageways 50 is controlled and guided by engagement of corresponding grooves 40 and projecting elements 58.

The assembled internal support structure 10 is secured by assembling two actuators 60 and two springs 64 and inserting the free end of one actuator 60 through each hole 48 and inserting a retainer 62 through each serrated hole 56.

As described above, the retainer 62 and the actuator 60 are locked together when the claw element 88 engages with the internal groove.

Once assembled, manual adjustment of the shoulder and head elements 12, 16 relative to the connecting member 42 (neck element 14) is controlled by rotating one or both fastening units 17 via the head 66. Rotation of each fastening unit 17 is enabled by depressing the head 66. This action compresses the spring 64, which overrides the spring force and displaces the head 80 of the retainer 62 from the serrated hole 56. Once the retainer 62 is released, the fastening unit 17 can rotate such that the serrated head-end portion 72 of the actuator 60 engages with the teeth 36 on the adjusting members 28.

Rotation of the fastening unit 17 converts to translational movement of the adjusting members 28 to displace the corresponding end portions of the shoulder element 12 and the head element 16 to adjust spacing between the shoulder and head elements 12, 16.

In the illustrated example, clockwise rotation of the head 66 separates the corresponding end portions of the shoulder element 12 and head element 16 and anti-clockwise rotation of the head 66 moves the corresponding end portions closer together.

It should be appreciated that each actuator 60 (fastening unit 17) can be actuated independent of the other. As such spacing between the shoulder element 12 and the head element 16 can be varied along the length/breadth of the internal support structure 10.

It should be appreciated that the spacing between the shoulder element 12 and the head element 18 can be uniform along the length/breadth of the internal support structure 10 if both actuators 60 (fastening units 17) are adjusted by the same degree independently or synchronously.

The free end portion 70 of the actuator 60 engages with an adjustment member 28 on corresponding ends of the shoulder element 12 and the head element 16. As such, adjustment by each actuator 60 (fastening unit 17) synchronously moves the corresponding ends of the shoulder and head element 12, 16 relative to the neck element 14.

When the desired spacing between the head and shoulder element 12, 16 is reached (i.e. to suit the shape of the user's jaw line and the distance between the shoulder and the jawline/lower face) release of the head 66 activates the spring 64 to align and locate the serrated head 80 with the serrated hole 56 to lock the setting of the shoulder element 12 and the head element 16 until the actuator 60 is released again by depression and rotation.

Referring to FIGS. 6 and 7 an anchored head supporting travel accessory 100 is illustrated. The anchored head supporting travel accessory 100 includes a garment 110, which encases the inner support structure 10 as illustrated in FIGS. 1 to 4.

FIG. 6 illustrates an example of how the anchored head supporting travel accessory 100 can be worn, where the internal support structure 10 rests on the model's left shoulder, against the left side of the model's neck and adjacent the left side of the model's chin and jaw.

It will be appreciated that the contour of the inside-facing surfaces of the internal support structure 10 complement the curvature between the model's shoulder and the model's jaw and chin.

As noted above, the garment 110 encases the internal support structure 10. Therefore, the only visible part of the internal support structure in FIGS. 6 and 7 are the heads 66 of the fastening units 17. As noted above, the heads 66 are shaped like a toggle fastener.

Figure 8A:
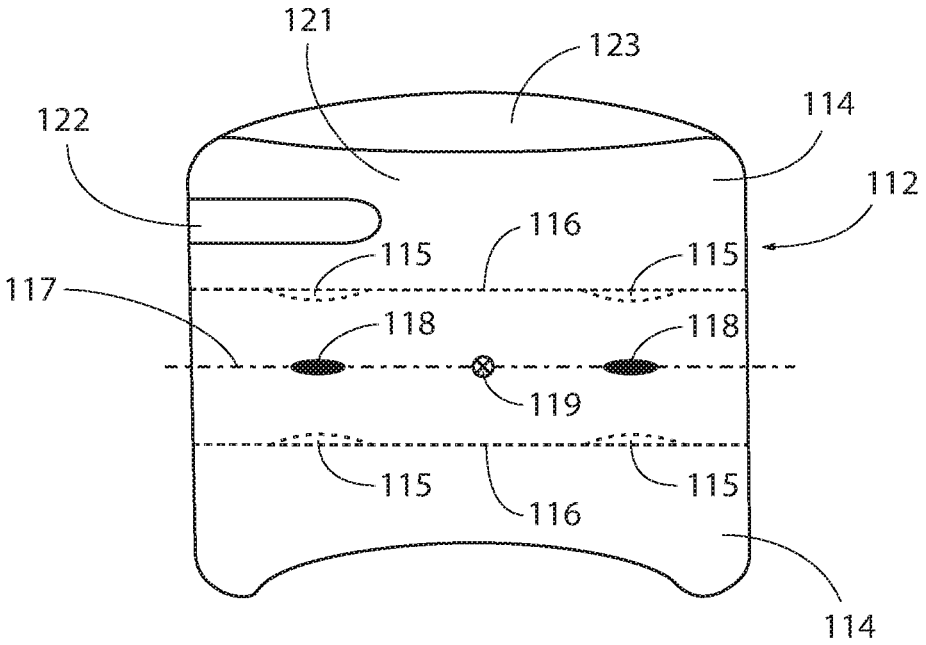
FIG. 8*a* is a front view of a garment configured to encase the internal support structure illustrated in FIGS. 1 to 4.
Figure 8B:
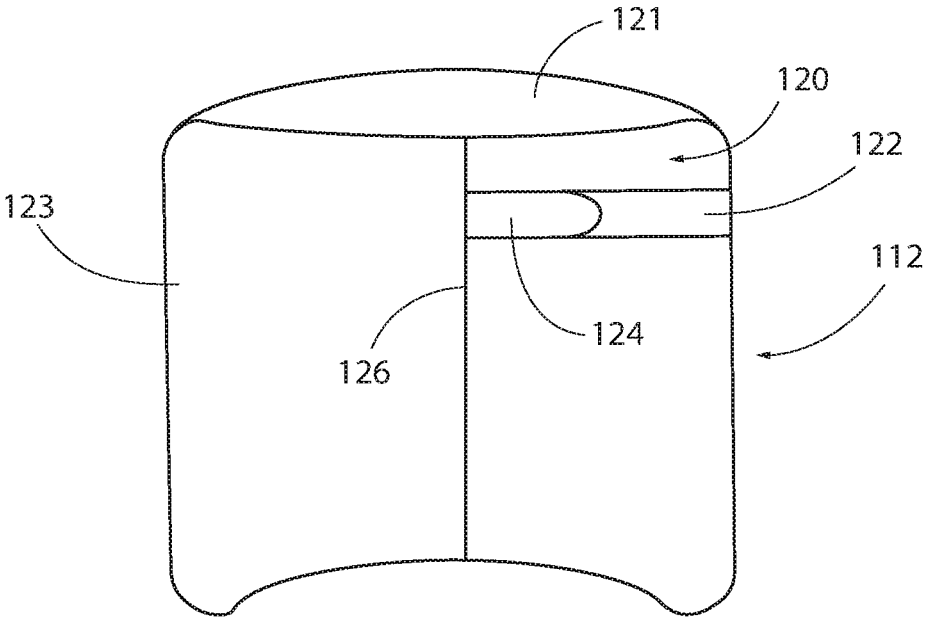
FIG. 8*b* is a rear view of a garment configured to encase the internal support structure illustrated in FIGS. 1 to 4.

Referring to FIGS. 8*a* and 8*b*, in the illustrated example the garment 110 is provided by a sleeve 112, which includes two pockets 114 (shown in dotted lines) extending along the inside of the front portion of the sleeve 112. One pocket is located at the top and one pocket is located at the bottom of the sleeve 112 as shown in FIG. 6*a*.

Each pocket 114 is partially closed along the edge 116 facing the centreline 117 of the sleeve 112. The edge 116 includes two openings 115. The openings 115 provide insertion points for the shoulder and head elements 12, 16, where the shoulder and head elements 12, 16 are fully inserted into the pockets via the ends 24 of the curved limbs (see FIGS. 1 to 4) being inserted into the openings 115.

Two holes 118 are symmetrically placed along the centre line 117 and about the midway point 119 on the front 121 of the sleeve 112. Each hole 118 allows the heads 66 of the actuators 60 to extend through from inside the sleeve to the outside of the sleeve 112 such that the head 66 of the actuator 60 (fastening units 17) is exposed from the front 121 of the sleeve 112.

By exposing the head 66 of the actuator 60, the user gains easy access to the actuator 60 (fastening unit 17), which facilitates manual adjustment of the spacing between the shoulder element 12 and the head element 16.

In the illustrated example, a length of hook and loop fastening tape 122 is provided around one half of the sleeve 112 and a complementary hook and loop adjusting tab 124 is fixed at one end 126 to the rear 123 of the sleeve 112.

To don the illustrated garment 110, the garment 110 is pulled over the user's head in a similar manner to donning a sweater or snood. The user can adjust the position of garment 110 such that the internal support structure 10 is placed against the neck in a desired position, for example to the side (as illustrated), to the front or to the rear of the neck.

In the illustrated example, the depth of the sleeve 112 (and the garment 110) is deeper than the user's neck such that excess fabric will gather like a turtle neck sweater or scarf to enhance comfort and appearance.

After locating the garment 110 in the desired position, the garment 110 can be secured by adjusting a hook and loop fastening system 120 provided on the upper section of the garment 110.

An anchored head supporting travel accessory 100, is provided when the garment 110 is comfortably tightened against the neck. The garment 110 is tightened by bringing the tab 124 forward and securing the tab 124 to the length of hook and loop fastening tape 122 towards the front of the garment (see FIGS. 8*b* and 9). This adjustment optimises comfort and support for the user. The garment 110 is released or loosened by releasing the tab 124 and removing the garment 110 over the user's head.

A twin tab arrangement (not illustrated) is an alternative to the illustrated example for adjusting the fit of the garment. The twin tab arrangement allows the garment 110 to be placed over the head from either side of the sleeve 112 and allows adjustment to be made by bringing the forwardmost tab forwards and securing to the hook and loop fastening tape.

Figure 10A:
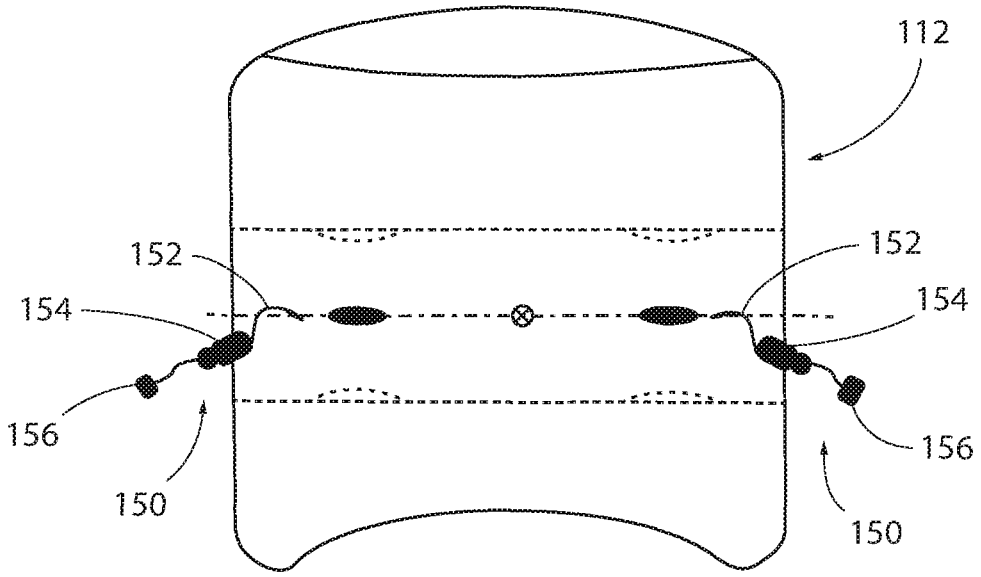
FIG. 10*a* illustrates an example of a dual toggle and cord arrangement for adjusting the fit of the garment relative to the user's neck.
Figure 10B:
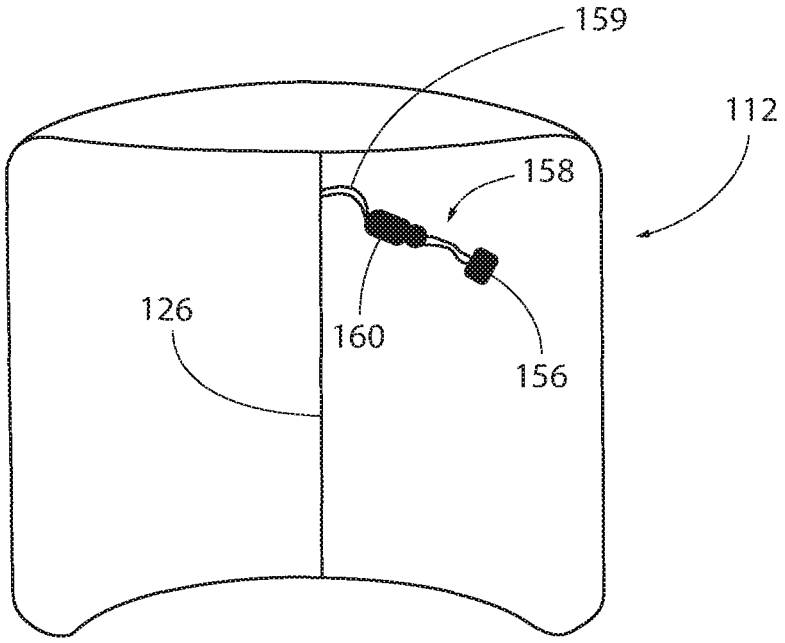
FIG. 10*b* illustrates an example of a single toggle and cord arrangement for adjusting the fit of the garment relative to the user's neck.

Referring to FIGS. 10*a* and 10*b*, in the illustrated example the garment 110 is provided by a sleeve 112, as described above with reference to FIGS. 8*a* and 8*b*.

In the illustrated examples, a pull cord and toggle arrangement is illustrated as a means of adjusting the fit of the garment 110 against the user's neck.

FIG. 10*a* illustrates a dual toggle arrangement 150, where a pull cord 152 and a toggle 154 are located at each side of the holes 118. A stop element 156 is provided at the end of each cord 152 to prevent removal of the toggle 154.

It will be appreciated the cord 152 passes through the internal wall of the sleeve 112 and permits adjusting the fit of the garment 110 relative to the user's neck by adjusting the position of one or both toggles 154 relative to the end of cord to which the toggle 154 is attached.

FIG. 10*b* illustrates a single toggle arrangement 158, where the pull cord 159 enters and exits the sleeve 112 as a twin cord at the rear seam 126. As with the example illustrated in FIG. 10*a* the fit of the garment 110 is adjusted by sliding the toggle 160 along the twin cord 158.

In the examples illustrated in FIGS. 10*a* and 10*b*, tightening the garment 110 is achieved by sliding the toggle 154, 160 along the cord 152, 158 in a direction towards the garment 110 and loosening the garment 110 is achieved by the reverse action, where the toggle 154, 160 slides relative to the cord 152, 158 away from the garment 110.

FIG. 11*a*, 11*b* and FIGS. 12*a* to 12*d* illustrate an example of a scarf 200 containing the internal support structure 10.

Figure 11A:
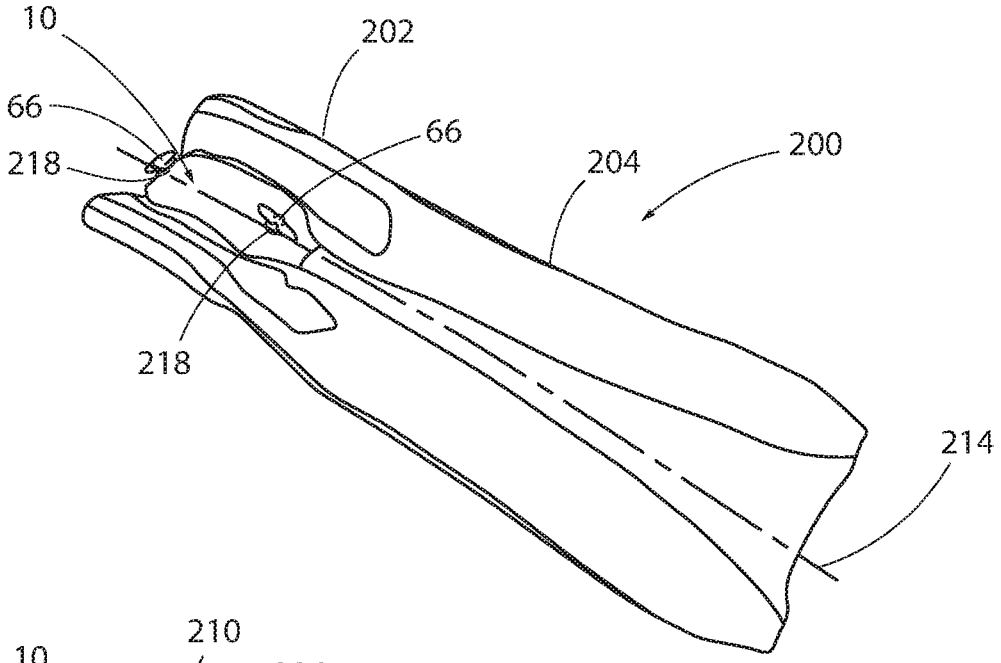
FIG. 11*a* illustrates an isometric view of an outside surface of a scarf containing the internal support structure as illustrated in FIGS. 1 to 4.
Figure 11B:
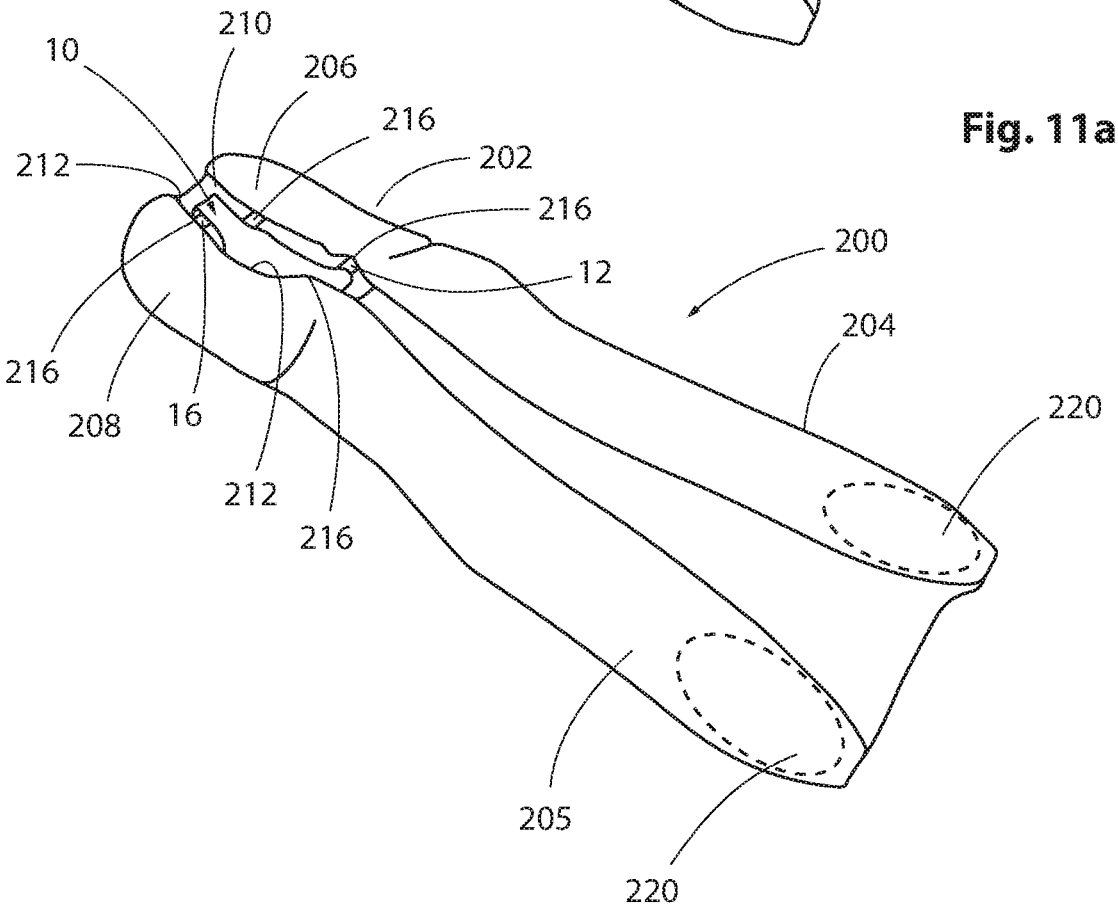
FIG. 11*b* illustrates an isometric view of an inside surface of a scarf containing the internal support structure as illustrated in FIGS. 1 to 4

Referring to FIGS. 11*a* and 11*b*, in the illustrated example the scarf 200 includes a head portion 202 and a tail portion 204, where the tail portion 204 is an elongated length of material extending from the head portion 202. The head portion 202 houses the internal support structure 10.

The head portion 202 includes two pockets 206, 208 extending along the inside surface (FIG. 11*b*) of the head portion 202. One pocket 206 extends down from a top edge of the head portion 202 and a second pocket 208 extends up from a bottom edge of the head portion 202.

Similar to the example described above with reference to FIG. 8*a*, each pocket 206, 208 is partially closed along an edge 210, 212 adjacent to the centreline 214 of the scarf 200. Each edge 210, 212 includes two openings 216. The openings 216, provide insertion points for the shoulder and head elements 12, 16 of the internal support structure 10. The shoulder and head elements 12, 16 are fully inserted into the pockets 206, 208 via the ends of the curved limbs (see FIGS. 1 to 4) being inserted into the openings 216.

Two holes 218 are symmetrically placed along the centre line 214 on the outside surface (FIG. 11*a*) of the head portion 202. Each hole 218 allows the toggle-shaped heads 66 of the actuators (see FIG. 3) to extend through from the inside surface of the scarf 200 to the outside of the scarf 200 such that the toggle-shaped heads 66 are exposed and accessible to the user to manually adjust the spacing between the shoulder element 12 and the head element 16 (see FIG. 2) such that, in use, the internal support structure 10 comfortably rests against the users head, neck and shoulder.

In the illustrated example, a length of hook fastening tape 220 is provided adjacent the inside edges of an end section 205 of the tail portion 204.

In the illustrated example, the material on the outside surface of the scarf 200 provides a material that complements the hook fastening tape 220 such that the end section 205 of the tail portion 204 can be secured at any position to the outside surface of the scarf 200 when the tail portion 204 is wrapped around the internal support structure 10 and the user's neck. This anchors the internal support structure 10 against the user's neck whilst maintaining the position of the head element 16 relative to the lower part of the user's face, for example the jaw line, as illustrated in FIGS. 12*a* to 12*d*.

Figure 12A:
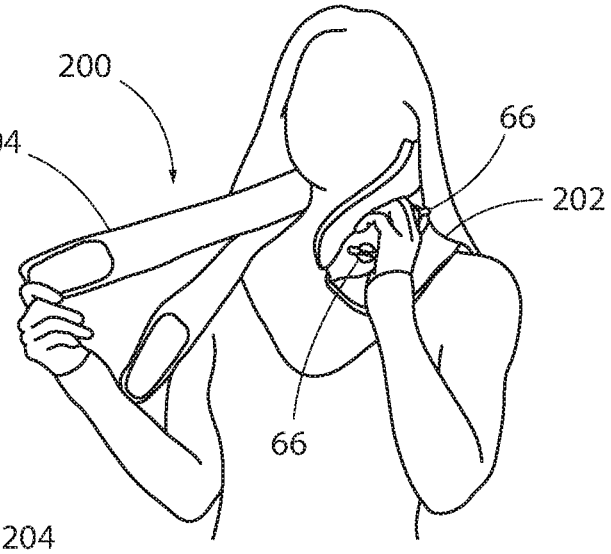
FIG. 12*a* illustrates application of the scarf illustrated in FIG. 11 to a user's neck.
Figure 12B:
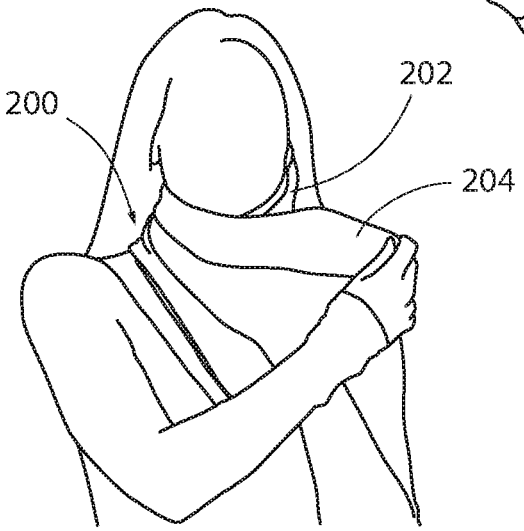
FIG. 12*b* illustrates the scarf of FIG. 12*a* being wrapped around the user's neck towards the location of the internal support structure.

FIGS. 12*a* to 12*d* illustrate how a user puts on the scarf 200. Referring to FIG. 12*a*, the user places the scarf 200 about their neck such that the tail portion 204 extends forward of the head portion 202 and the head portion 202, containing the internal support structure 10, is placed against their neck. Once the head portion 202 is in the desired position, for example, to the side (as illustrated), to the front or to the rear of the neck the user adjusts the spacing between the first (front) ends of the head element and the shoulder element and the spacing between the second (rear) ends of the head element and the shoulder element such that the spacing corresponds with the length of the user's neck and, in the illustrated example, the shape of the jawline. The spacing is adjusted by releasing and turning the actuators 66, as described above.

Figure 12C:
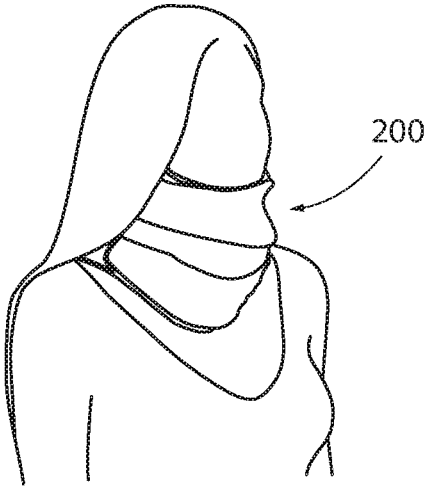
FIG. 12*c* illustrates the scarf of FIGS. 12*a* and 12*b* secured around the user's neck.

Once the spacing between the head element 16 and the shoulder element 12 is satisfactory, the user wraps the tail portion 204 around their neck and the head portion 202 (see FIG. 12*b*) to secure/anchor the head portion 202 and the internal support structure against the user's neck (see FIG. 12*c*).

Figure 12D:
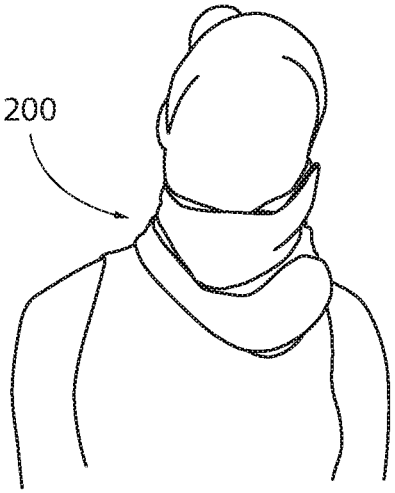
FIG. 12*d* illustrates the user's head tilted, resting and being supported by the end section of the scarf containing the internal support structure of FIGS. 1 to 4.

After securing the scarf 200 around the user's neck, the internal support structure 10 (not visible) is positioned to provide support to the user's head as it tilts towards and rests on the head element 16 of the internal support structure 10, as illustrated in FIG. 12*d*. As described above, as the weight of the user's head is applied to the head element, the load applied to the internal support structure 10 is borne by the user's shoulder area via the shoulder element 12.

Whilst specific embodiments of the present invention have been described above, it will be appreciated that departures from the described embodiments may still fall within the scope of the present invention.

What is claimed is:

1. An adjustable head supporting apparatus configured, in use, to be anchored against a user's neck, wherein the apparatus comprises:

a contoured head element;

a contoured shoulder element; and at least one connecting member connectable to each of the head element and the shoulder element;

wherein the at least one connecting member is configured to link respective ends of the head element with respective ends of the shoulder element; and wherein the at least one connecting member facilitates displacing the head element and the shoulder element to adjust spacing between the head element and the shoulder element, wherein displacement of a first end of the head element relative to a first end of the shoulder element can be independent of displacement of a second end of the head element relative to a second end of the shoulder element;

at least one fastening unit joins the connecting member, the head element and the shoulder element, wherein the fastening unit is operable to lock together the connecting member, the head element and the shoulder element thereby preventing displacement of the head and shoulder element; and wherein upon releasing the fastening unit displacement of the head and shoulder element is permitted, wherein the fastening unit comprises:

an actuator, which facilitates manual release and manual displacement of the fastening unit relative to the connecting member, the head element and the shoulder element, and wherein displacement of the fastening unit causes displacement of corresponding ends of the head and shoulder element; and a retaining element configured to engage with the connecting member, thereby preventing displacement of the fastening unit until release of the retaining element from the connecting member; and wherein, in use, at least the head element and the shoulder element are encased within a fabric garment, wherein, in use, the fabric garment anchors the adjustable head supporting apparatus against a user's neck, wherein the fastening unit further comprises a resilient member operable to bias the fastening unit to a locked configuration, wherein upon applying a bias-overriding load to the fastening unit, via the actuator, the fastening unit is released and capable of displacing the head and shoulder element.

2. The adjustable head supporting apparatus as claimed in claim 1, wherein the retaining element and the connecting member each comprise complementary mating surfaces, wherein in the locked position the mating surfaces prevent displacement of the fastening unit, wherein upon release of the actuator, the resilient member is operable to at least partially displace the fastening unit thereby aligning the mating surfaces of the retaining element and the connecting member such that the biasing force of the resilient element automatically locks the fastening unit and the connecting member, thereby preventing displacement of the head element and the shoulder element.

3. The adjustable head supporting apparatus as claimed in claim 1, wherein each of the head element and the shoulder element comprise adjusting members comprising a serrated edge configured to engage with a complementary serrated surface on the fastening unit, wherein upon releasing the fastening unit rotation of the fastening unit is permitted, wherein rotation of the fastening unit causes translational displacement of the head element and the shoulder element relative to a stationary connecting member; and wherein rotation of the fastening unit synchronously displaces the head element and the shoulder element.

4. The adjustable head supporting apparatus as claimed in claim 3, wherein the head element and the shoulder element each comprise at least one adjusting member, wherein an adjusting member of each of the head element and the shoulder element is engageable with the fastening unit.

5. The adjustable head supporting apparatus as claimed in claim 3, wherein the connecting member comprises a passageway configured to receive and guide an adjusting member from each of head element and the shoulder element, wherein either the passageway or the adjusting member includes a projecting element and the other of the passageway and the adjusting member includes a groove, wherein the projecting element engages with and is guided in the groove, wherein the passageway guides translational movement of the adjusting members of the head element and the shoulder element.

6. The adjustable head supporting apparatus as claimed in claim 3, wherein upon rotation of the fastening unit, the head element and shoulder element displace translationally in opposite directions due to engagement of the adjusting members with a body of the fastening unit.

7. The adjustable head supporting apparatus as claimed in claim 1, wherein the connecting member is elongated, providing a unitary connecting member, which is configured to be linked at each end to a corresponding end of each of the head element and the shoulder element and wherein a fastening unit is provided at each end.

8. The adjustable head supporting apparatus as claimed in claim 3, wherein the head element and the shoulder element are each provided by a contoured support member comprising asymmetrically spaced adjusting members, wherein an adjusting member of two contoured support members are engageable with each fastening unit.

9. The adjustable head supporting apparatus as claimed in claim 8, wherein the unitary connecting member comprises a passageway at both ends, wherein a fastening unit passes through the connecting member and the passageway, such that the body of the fastening unit engages with the adjusting members received in the respective passageway.

10. The anchored head supporting apparatus as claimed in claim 1, wherein the garment is provided by a sleeve, which includes two pockets extending along an inside of a front portion of the sleeve, wherein a closed end of a first pocket is located adjacent a first open end of the sleeve and a closed end of a second pocket is located adjacent a second open end of the sleeve.

11. The anchored head supporting apparatus as claimed in claim 10, wherein each pocket is partially closed along an inner edge adjacent to a centreline of the sleeve, wherein each inner edge includes two openings, which provide insertion points for the shoulder and head elements.

12. The anchored head supporting apparatus as claimed in claim 10 wherein two holes are symmetrically placed along the centre line and about a midway point on the front of the sleeve, wherein each hole permits a head of a manual actuator to extend through from inside to outside of the sleeve such that the heads are exposed and accessible to the user to manually adjust the spacing between the shoulder element and the head element.

13. The anchored head supporting apparatus as claimed in claim 12, wherein a front surface of the sleeve adjacent to each hole comprises an external pocket at least partially concealing the hole such that in use an open edge of each pocket overlaps the head of the manual actuator such that the head of the manual actuator can be revealed or concealed by moving the open edge of the pocket relative to the head of the manual actuator.

14. The anchored head supporting apparatus as claimed in claim 1, further comprising an adjuster, which is operable to tighten the fabric garment about the user's neck.

15. The anchored head supporting apparatus as claimed in claim 14, wherein the adjuster comprises a pull cord and toggle assembly, wherein a cord extends within the garment and wherein moving the toggle relative to the cord towards the garment facilitates tightening the garment by gathering the garment about the user's neck and wherein moving the toggle relative to the cord away from the garment facilitates releasing the cord and loosens the garment for ease of removal.

16. The anchored head supporting apparatus as claimed in claim 14 wherein the adjuster comprises a dual-toggle assembly, wherein a first toggle is located adjacent to a first end of the adjustable head supporting apparatus and a second toggle is located adjacent to a second end of the adjustable head supporting apparatus.

17. The anchored head supporting apparatus as claimed in claim 14, wherein the adjuster comprises a hook and loop system configured to permit tightening the garment about a user's neck thereby anchoring the adjustable head supporting apparatus relative to a user's head, neck and shoulder, wherein the hook and loop fastening system includes hook and loop fastening around at least part of the garment and at least one tab of complementary hook and loop fastener, wherein adjustment is facilitated by adjusting the position of the tab relative to the hook and loop fastening around the garment, thereby tightening or loosening the garment relative to the user's neck.

18. The anchored head supporting apparatus as claimed in claim 1, wherein the garment is provided by an elongated scarf comprising a head portion and a tail portion, wherein the tail portion is an elongated length of material extending from the head portion; and wherein the head element and the shoulder element are encased in the head portion.

19. The anchored head supporting apparatus as claimed in claim 18, wherein the head portion includes two pockets extending along an inside surface of the head portion, wherein a first pocket extends down from a top edge of the head portion and a second pocket extends up from a bottom edge of the head portion.

20. The anchored head supporting apparatus as claimed in claim 19, wherein each pocket is partially closed along an internal edge, which is provide adjacent to an axial centreline of the scarf.

21. The anchored head supporting apparatus as claimed in claim 20, wherein each internal edge includes two openings, wherein the openings provide insertion points for the shoulder and head elements of the internal support structure.

22. The anchored head supporting apparatus as claimed in claim 20, wherein two holes are symmetrically located on the axial centre line and through an outside surface of the head portion and wherein a head of an actuator extends through a respective hole from the inside surface of the scarf to the outside of the scarf such that the heads are exposed and accessible to the user to manually adjust the spacing between the shoulder element and the head element.

23. The anchored head supporting apparatus as claimed in claim 18, wherein one or more sections of hook fastening are provided adjacent inside edges of an end section of the tail portion.

24. The anchored head supporting apparatus as claimed in claim 23, wherein the outside surface of the scarf includes a material that complements the hook fastening such that inside an end section of the tail portion can be secured to the outside surface of the scarf when the tail portion is wrapped around the internal support structure and the user's neck.

25. The anchored head supporting apparatus as claimed in claim 23, further comprising one or more sections of loop fastening along the length of the scarf on the outside surface extending from the tail portion such that inside an end section of the tail portion can be secured to the outside surface of the scarf when the tail portion is wrapped around the internal support structure and the user's neck.

* * * * *